US012458065B2

(12) United States Patent
Yamaguchi

(10) Patent No.: US 12,458,065 B2
(45) Date of Patent: Nov. 4, 2025

(54) CONSUMABLE RETAINING MECHANISM

(71) Applicant: JT International S.A., Geneva (CH)

(72) Inventor: Akira Yamaguchi, Geneva (CH)

(73) Assignee: JT International SA (CH)

( * ) Notice: Subject to any disclaimer, the term of this patent is extended or adjusted under 35 U.S.C. 154(b) by 1098 days.

(21) Appl. No.: 17/260,066

(22) PCT Filed: Sep. 2, 2019

(86) PCT No.: PCT/EP2019/073319
§ 371 (c)(1),
(2) Date: Jan. 13, 2021

(87) PCT Pub. No.: WO2020/053009
PCT Pub. Date: Mar. 19, 2020

(65) Prior Publication Data

US 2021/0282459 A1 Sep. 16, 2021

(30) Foreign Application Priority Data

Sep. 14, 2018 (EP) ..... 18194398

(51) Int. Cl.
*A24F 40/42* (2020.01)
*A24F 40/20* (2020.01)
*A24F 40/46* (2020.01)

(52) U.S. Cl.
CPC ..... *A24F 40/42* (2020.01); *A24F 40/20* (2020.01); *A24F 40/46* (2020.01)

(58) Field of Classification Search
CPC ..... A24F 40/20; A24F 40/46; A24F 40/42
See application file for complete search history.

(56) References Cited

U.S. PATENT DOCUMENTS 1,527,991 A * 3/1925 Murphy ..... A24F 13/10 279/35
5,954,979 A * 9/1999 Counts ..... A24F 40/485 131/194

(Continued)

FOREIGN PATENT DOCUMENTS

AT 167198 B 11/1950
CN 203864519 U 10/2014

(Continued)

OTHER PUBLICATIONS

International Search Report for Application No. PCT/EP2019/073319, mailed Nov. 27, 2019, pp. 1-4.

(Continued)

*Primary Examiner* — Alex B Efta
(74) *Attorney, Agent, or Firm* — Lerner David LLP

(57) ABSTRACT

A mouthpiece portion for an electronic cigarette includes a housing sleeve including an opening and a cavity having an internal side wall, the housing sleeve being connectable to a main body of an electronic cigarette; a retaining element located within the cavity, wherein the retaining element defines a receiving space for receiving a portion of a consumable and is configured to move within the housing sleeve in the axial direction of the mouthpiece portion between a first position and a second position; wherein the retaining element is compressed in the radial direction against the consumable by the side wall of the housing sleeve when the retaining element is in the second position and wherein the consumable is released or partially released from the retaining element when the retaining element is in the first position.

19 Claims, 11 Drawing Sheets

(56) References Cited

U.S. PATENT DOCUMENTS

| | | | | |
|---|---|---|---|---|
| 6,491,040 | B1 | 12/2002 | Hsueh | |
| 2015/0013696 | A1* | 1/2015 | Plojoux | A61M 15/06 131/328 |
| 2016/0007649 | A1 | 1/2016 | Sampson et al. | |
| 2016/0135495 | A1 | 5/2016 | Poget et al. | |
| 2017/0042225 | A1 | 2/2017 | Liu | |
| 2017/0162979 | A1 | 6/2017 | Liu | |
| 2017/0196261 | A1 | 7/2017 | Borges De Couraca et al. | |
| 2017/0360095 | A1 | 12/2017 | Batista | |
| 2018/0000157 | A1 | 1/2018 | Batista et al. | |
| 2018/0049472 | A1* | 2/2018 | Mahler | A24F 40/46 |
| 2018/0160724 | A1 | 6/2018 | Guyard et al. | |
| 2019/0183170 | A1 | 6/2019 | Zeng et al. | |
| 2020/0146351 | A1 | 5/2020 | Rogan | |

FOREIGN PATENT DOCUMENTS

| | | | |
|---|---|---|---|
| CN | 204104843 | U | 1/2015 |
| CN | 104770875 | A | 7/2015 |
| CN | 104770894 | A | 7/2015 |
| CN | 105451581 | A | 3/2016 |
| CN | 106174699 | A | 12/2016 |
| CN | 107183788 | A | 9/2017 |
| CN | 108344686 | A | 7/2018 |
| CN | 108430243 | A | 8/2018 |
| EP | 3175722 | A1 | 6/2017 |
| GB | 798078 | A | 7/1958 |
| JP | H10203222 | A | 8/1998 |
| JP | 2010213579 | A | 9/2010 |
| JP | 2014-533513 | A | 12/2014 |
| JP | 2018-504134 | A | 2/2018 |
| KR | 2018-0070444 | A | 6/2018 |
| KR | 20180070443 | A | 6/2018 |
| WO | 2018024244 | A1 | 2/2018 |
| WO | 2018050612 | A1 | 3/2018 |
| WO | 2018122109 | A1 | 7/2018 |
| WO | 2018130664 | A1 | 7/2018 |

OTHER PUBLICATIONS

Search Report dated Jul. 10, 2024 from Office Action for Chinese Application No. 201980058942.6 issued Jul. 29, 2024. 3 pgs.

* cited by examiner

CONSUMABLE RETAINING MECHANISM

CROSS-REFERENCE TO RELATED APPLICATIONS

The present application is a national phase entry under 35 U.S.C. § 371 of International Application No. PCT/EP2019/073319, filed Sep. 2, 2019, published in English, which claims priority to European Application No. 18194398.6 filed Sep. 14, 2018, the disclosures of which are incorporated herein by reference.

FIELD

The present invention relates to a retaining mechanism for an electronic cigarette enabling a consumable to be retained in the mouthpiece portion of the electronic cigarette.

BACKGROUND

Electronic cigarettes, otherwise known as e-cigarettes, often comprise a mouthpiece portion configured to receive consumables containing a substance to be released to the user as they inhale from the device. Typical substances contained within consumables can include tobacco material, flavourings and/or nicotine.

The consumables can have a rod shape and are inserted into a cavity in the mouthpiece portion of the device. Some consumables include tobacco rods comprising a tobacco substrate immersed in propylene glycol or glycerol. These consumables typically have a tobacco portion and a mouthpiece filter portion and resemble a traditional cigarette. These consumables release a vapour when they are exposed to a heating arrangement in the electronic cigarette.

Another type of consumable is a flavoured filter. This consumable is typically used together with an electronic cigarette configured for liquid vaporisation and can be used in order to alter the flavour of the vapour.

Hence, these two types of consumables can act as the region of the e-cigarette which is in contact with the user's mouth, in a similar way as a filter would in a traditional cigarette.

After a period of use the consumable becomes depleted, and a new consumable is required. A user therefore needs to remove the consumable from the e-cigarette and either replace or refill it.

As the consumable is a replaceable part of the e-cigarette, it is desirable that the consumable is securely held to avoid it moving or accidently becoming detached from the e-cigarette, whilst still being easily removable from the e-cigarette when necessary.

SUMMARY

According to an aspect of the invention there is provided a mouthpiece portion for an electronic cigarette, the mouthpiece portion comprising a housing sleeve comprising an opening and a cavity having an internal side wall, the housing sleeve being connectable to a main body of an electronic cigarette; a retaining element located within said cavity, wherein the retaining element defines a receiving space for receiving a portion of a consumable and is configured to move within the housing sleeve in the axial direction of the mouthpiece portion between a first position and a second position; wherein the retaining element is compressed in the radial direction against the consumable.

The retaining element may be compressed in the radial direction against the consumable when the retaining element is in the second position and wherein the consumable is released or partially released from the retaining element when the retaining element is in the first position.

Hence, the mouthpiece portion can define a central axis which is substantially parallel to an insertion direction of the consumable. The cavity can be at least partly defined by an internal side wall of the housing sleeve which substantially surrounds the central axis of the mouthpiece portion.

Advantageously, the retaining element securely holds the consumable in the mouthpiece. The movement of the retaining element from the first to the second positions causes the side wall of the cavity to compress the retaining element, such that the retaining element has a smaller diameter, locking the consumable in the mouthpiece portion when in the second position.

This mechanism securely holds the consumable in the mouthpiece stopping it from moving and prevents the consumable from becoming accidentally detached from the mouthpiece.

Preferably, the cavity is provided with a first portion having a first diameter, and a second portion having a second diameter wherein the second diameter is smaller than the first diameter. In this way the side wall may have a first diameter when the retaining element is in the first position and the second diameter when in the second position. The larger diameter of the side wall when in the first position enables the consumable to be released or partially released from the retaining element, whereas the smaller diameter when in the second position results in the side wall of the housing sleeve providing the compression.

Preferably, the first portion and the second portion are located at different longitudinal positions in the axial direction of the cavity.

The first position may be closer to the opening than the second position. In this way, upon initial insertion of the consumable into the first end of the cavity the retaining element is in its first position and upon movement of the consumable further into the cavity the retaining element moves to the second position. This enables easy insertion of the consumable, whilst providing a secure hold of the consumable when fully inserted. Alternatively, the second position may be closer to the opening than the first position.

Preferably, the side wall is flared. This may be a flared opening, such that when the retaining element is in the second position the separation of opposing sides of the side wall in contact with the retaining element is narrower than when in the first position. The flared side wall may define a tapered angle which is inwardly tapered in a direction towards a vapour outlet in the mouthpiece portion. The narrowing separation defined by the side wall in the second position compresses and holds the consumable, with the wider separation in the first position enabling the consumable to be easily removed from the mouthpiece.

Preferably, the retaining element comprises one or more slits extending along at least a portion of the retaining element in the axial direction, which allows compression or expansion of the retaining element. Having one or more slits enables the retaining element to be easily compressed when in the second position, by providing a compression gap. This enables the retaining element to be made from a rigid material whilst enabling it to expand and compress. In other embodiments, the compression of the retaining element may be achieved by having a retaining element that is made of a deformable material that permits compression, which is capable of returning to its original shape after no longer being compressed. The retaining element may be a flexible sleeve. For instance, the retaining element might be a plastic or a rubber material.

Preferably, the retaining element is a ring shape. Having a ring shape means that the retaining element can match the contours of the consumable which are typically cylindrical. The ring shape enables the retaining element to surround the circumference of the consumable to provide a more secure hold.

The slits may separate the retaining element into separate sections. In this way the retaining element is comprised of two or more separate sections. Compression of the side wall on the retaining element sections causes them to clamp onto the consumable. In some embodiment the retaining elements might further include additional slits which do not extend the whole length of each of the separate sections, enabling a greater compression to be achieved. Alternatively, the retaining element may take the form of a cylindrical mesh of cross-linked struts arranged in a similar manner to, for example, medical stents, such that radial compression of the retaining member causes it to deform radially inwardly and axially outwardly. By using resilient material such as plastic or metal, the retaining element will tend to revert to its at rest state when radially inward pressure is removed (e.g. by moving the retaining element from the second to the first position).

The retaining element may comprise a protrusion, and the side wall of the cavity comprises at least one axial groove configured to receive the protrusion and guide the protrusion so that the retaining element can move between the first and second positions. The groove provides a guide in which the protrusion can move up and down whilst preventing rotational motion of the retaining portion. This prevents the consumable from twisting when located within the mouthpiece. Further, the protrusion acts as a region to which the side wall can provide pressure to compress the retaining element.

Preferably, the groove comprises at least a first and a second recess, the first recess configured to engage with the protrusion when it is in the first position and the second recess configured to engage with the protrusion when in the second position, wherein the first recess has a greater radial depth than the second recess. As the protrusion is received and held within the first recess when in the first position, the first recess prevents the retaining element from being pulled out of the mouthpiece. In this situation the retaining element is not compressed and the consumable can easily be removed from the mouthpiece. Having a second recess that is shallower than the first recess means that when the consumable is pushed into the mouthpiece, the retaining portion is moved to the second position and the protrusion is received in the second recess. As the second recess is not as deep as the first recess, the reduction in space between the retaining element and the side wall causes compression of the retaining element, enabling the consumable to be securely held.

Preferably, the side wall of the cavity comprises a protrusion, and wherein the retaining element comprises an axial groove having a variable radial depth such that the retaining element can move between the first and second positions.

Advantageously, having a protrusion in the side wall of the cavity provides a region that reduces the diameter of the space that the retaining element is within when in the second position, providing the compression. The protrusion may be a single protrusion, or it may alternatively be a plurality of protrusions which extend along the axis that the retaining portion moves along between the first and second positions. For instance, the protrusions may successively extend radially outwards towards the retaining element along the axis, as the retaining element moves from the first to the second position, such that increased compression is applied as the retaining element moves from the first to the second position.

The retaining element may comprise at least one recess having a first portion and a second portion, wherein the first portion and the second portion have different radial depths, whereby the second portion is configured to engage with the protrusion when the retaining element is in the first position and the first portion is configured to engage with the protrusion when the retaining element is in the second position. In some instances the second portion may extend radially by a larger amount than the first portion.

As the protrusion is received and held within the second portion when in the first position, the second portion prevents the retaining element from being pulled out of the mouthpiece. In this situation the retaining element is not compressed and the consumable can easily be removed from the mouthpiece. Having a first portion that is shallower than the second portion means that when the consumable is pushed into the mouthpiece, the retaining portion is moved to the second position and the protrusion is now located in the first portion. As the first portion is not as deep as the second portion, the reduction in separation between the retaining element and the side wall causes compression of the retaining element, enabling the consumable to be securely held.

Alternatively, the first and second portions could be the same size and there may be a plurality of protrusions with different sizes.

Preferably, the side wall of the cavity has a tapered profile along the axial direction, such that when in the second position the side wall compresses the retaining element. With this arrangement when the retaining element is moved from the first to the second position the compression of the retaining element is gradual. This means that the further the consumable is pushed into the mouthpiece the greater the hold that the retaining element applies to the consumable.

The retaining element may be further connected to axial positioning arrangement, configured to reciprocatably move and retain the retaining element in a first position and a second position when a force is applied to the consumable. In addition, the retaining mechanism may be biased into the second position by the axial positioning arrangement.

Preferably the axial positioning arrangement comprises: an axially movable base to which the retaining element is attached; a cam configured to convert the axial movement of the base to a rotational displacement, a biasing member acting on the cam in order to bias the cam in the axial direction against the base, and a guide located on an internal surface of the housing sleeve. For instance, the retaining element may be coupled to a cam that is rotatable about an axis, between at least a first orientation and a second orientation, such that when the cam is in the first orientation the retaining element is in its first position and when the cam is in the second orientation the retaining element is in its second position.

Advantageously, this enables control of the movement of the retaining element between the first and second positions. This provides a clicking mechanism where the consumable can be clicked into or out of the mouthpiece. This mechanism may be similar to the mechanism in a clicking action in a retractable ball point pen.

According to a further aspect, there is provided an electronic cigarette comprising the mouthpiece portion of the above mentioned aspect.

DESCRIPTION OF DRAWINGS

Embodiments of the invention are now described, by way of example, with reference to the drawings, in which.

DETAILED DESCRIPTION

Figure 1A:
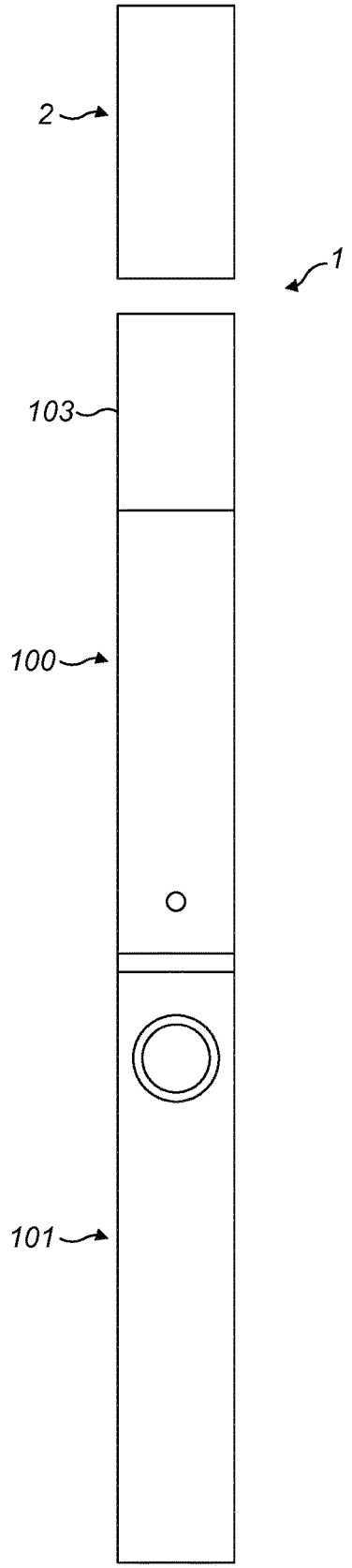
FIG. 1A is a schematic view of an electronic cigarette according to an exemplary embodiment of the present invention.
Figure 1B:
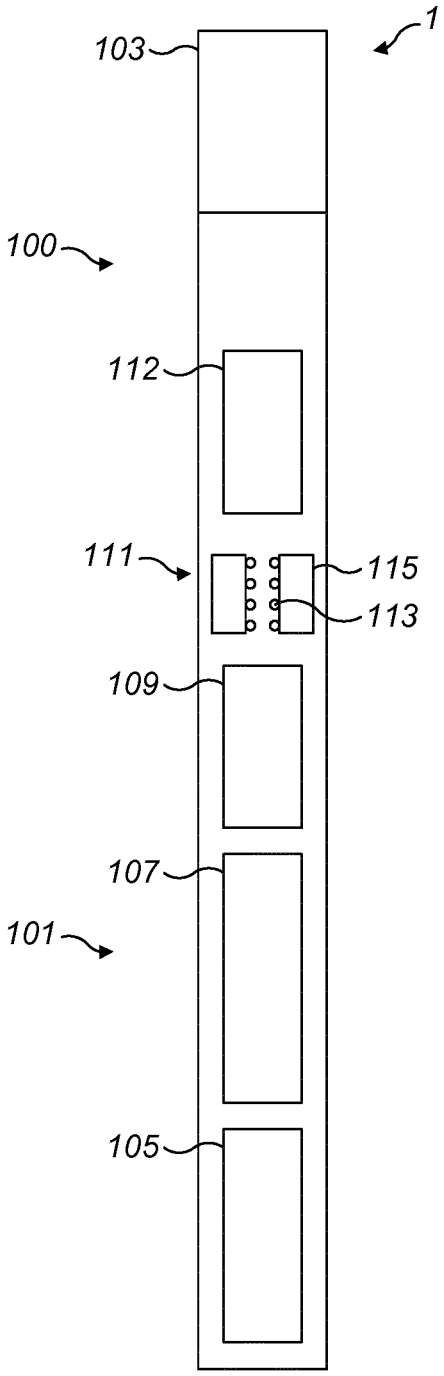
FIG. 1B is a schematic cross-sectional view of an electronic cigarette according to an exemplary embodiment of the present invention.

Referring to the drawings and in particular to FIGS. 1A and 1B, an electronic cigarette 1 is illustrated. The electronic cigarette 1 comprises a mouthpiece section 100 and a power supply section 101. The electronic cigarette 1 can be used as a substitute for a conventional cigarette. The mouthpiece section 100 comprises a mouthpiece 103 configured to receive a consumable 2.

Figure 1C:
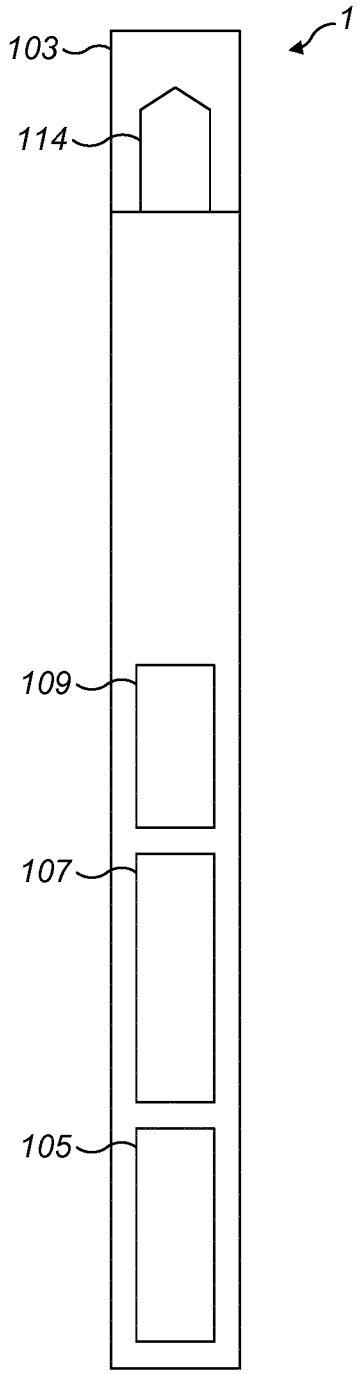
FIG. 1C is a schematic cross-sectional view of an electronic cigarette according to an exemplary embodiment of the present invention.

The electronic cigarette 1 is configured to produce a vapor. As illustrated in FIGS. 1B and 1C, the present electronic cigarette 1 can be either a liquid vaporiser or a heated tobacco type electronic cigarette 1. Hence, the consumable 2 can be used as an attachment to a liquid vaporizer by enhancing vapour with a flavor or a substance (such as nicotine). Typically, the flavor enhancement is provided as a consumable 2 in the form of a flavored filter 2. The housing of the liquid cartridge for use in the liquid vaporizer may have a somewhat flexible housing. The filter can also be provided without flavor and can be configured remove larger vapor droplets and projections from the vapor. Alternatively, the consumable 2 can be a tobacco rod comprising an aerosol-forming substance such as propylene glycol or glycerin and configured to release a vapor when heated, i.e. a so called "heat-stick".

As illustrated in FIGS. 1A and 1B, a liquid vaporizer may comprise a power supply section 101 and a mouthpiece portion 100. The power supply section 101 comprises a power unit 105, which may for instance be a rechargeable lithium battery or any other suitable power unit. The power supply section 101 further comprises a control unit 107 configured to control the operation of the electronic cigarette 1 based on manual user input or automatic input from one or several sensors 109. The control unit 107 is configured to receive and process manual input data and sensor data in order to activate a heater and the overall operation of the electronic cigarette 1. The power supply section 101 may advantageously comprise at least one sensor 109, such as a flow sensor 109 configured to sense an air flow through the electronic cigarette 1 which occurs when a user inhales from the mouthpiece 103. Other suitable sensors may include temperature sensors and sensors configured to detect depletion of a liquid store 112 in the consumable 2.

As illustrated in FIG. 1B, the electronic cigarette 1 may comprise a vaporizing unit 111 configured to vaporize liquid from the liquid store 112. The vaporizing unit 111 comprises a heating element 113 and a fluid transfer element 115. The fluid transfer element 115 is configured to transfer liquid by capillary action from the liquid store 112 to the heating element 113. The fluid transfer element 115 can be a fibrous or porous element such as a wick made from twined cotton or silica. Alternatively, the fluid transfer element 115 can be a porous element made from e.g. a ceramic material. The heating element 113 is not restricted to a particular type and can be a horizontal or vertical coil or a flat heating element. Moreover, the vaporizing unit 111 is not limited to use heat, but may for instance comprise a vibrating transducer element instead of a heater. The mouthpiece 103 configured to receive a consumable 2 in the form of a flavored element 2. The flavored element can be in the form of a flavored filter having an acetate or cellulosic structure immersed in a flavorant or provided with an encapsulated flavor. Hence, the flavored element 2 preferably has reduced filtration capabilities in order to let a maximum amount of vapor pass from the vaporizing unit 111 to the user.

Alternatively, as illustrated in FIG. 1C, the electronic cigarette 1 may be configured for heating consumables 2 comprising a tobacco substrate immersed in an aerosol-forming substance. The consumables 2 may comprise a tobacco portion and a mouthpiece filter portion. The electronic cigarette 1 therefore comprises a heater 114 located in a cavity of the mouthpiece 103 and configured to apply heat to the tobacco portion of the consumable 2 to a temperature of around 200 to 450° C. The consumables 2 release a vapour when they are exposed to the heat from the heater 114 in the electronic cigarette 1.

The electronic cigarette may therefore be arranged similar to the electronic cigarette in the embodiment illustrated in FIG. 1B, but instead of the vaporising unit 111, it comprises a heater 114 configured to heat a solid tobacco material.

The heater 114 may comprise an internal heater element in the form of a blade 114 or a rod. However, the heater 114 of the present invention is not limited to an internal heating system 114 and other types of heating systems 114 such as an external heating (such as induction or oven-type) systems are also possible.

Figure 2B:
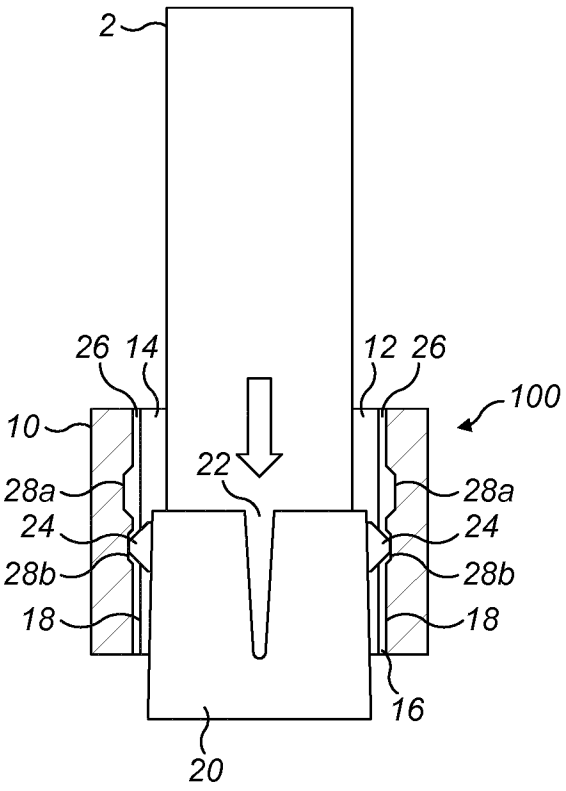
FIG. 2B is a side on cross-sectional view of a mouthpiece of an electronic cigarette and consumable in a second position, according to the first exemplary embodiment of the present invention.
Figure 2A:
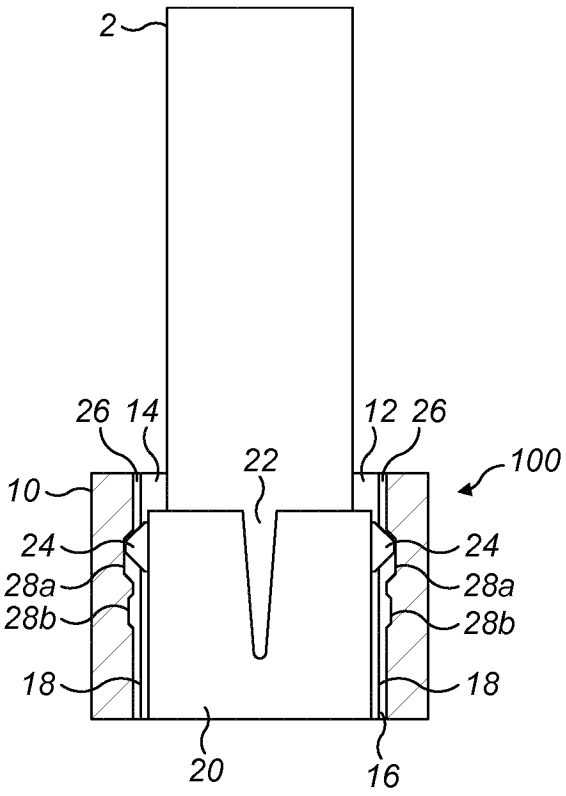
FIG. 2A is a side on cross-sectional view of a mouthpiece of an electronic cigarette and consumable in a first position, according to a first exemplary embodiment of the present invention.

FIGS. 2A and 2B show cross-sectional views of a mouthpiece portion 100 of an electronic cigarette 1 and consumable 2 according to a first exemplary embodiment of the present invention. FIG. 2A illustrates the electronic cigarette 1 when consumable is in a released position and FIG. 2B illustrates the mouthpiece when the consumable 2 is in a clamped position.

The mouthpiece portion 100 comprises a housing sleeve 10, having an opening at its first end 14 defining a cavity 12 having an internal sidewall 18. Within the cavity 12 of the housing sleeve 10 is located a retaining element 20. The retaining element 20 is cylindrical having an inner region defining the cavity 12' in which the consumable 2 is received. The retaining element 20 may comprise two slits 22 on opposite sides of the retaining element 20, the slits 22 extending down a portion of the retaining element 20. In other embodiments the retaining element 20 may only have a single slit 22, or a plurality of slits 22. The slits 22 enable the retaining element to be compressed in the radial direction.

The retaining element 20 has at least one protrusion 24, preferably two protrusions 24 on opposing sides of the retaining element 20. Each of the protrusions 24 are positioned circumferentially between the two slits 22.

The side wall 18 of the cavity include at least one groove 26, and preferably two grooves 26 which extend in the axial direction between the first end of the cavity 14 where the opening is, and a second end of the cavity 16. The two grooves 26 are located on opposing sides of the cavity 12 to one another. The grooves 26 comprise a first groove portion 28*a* and second groove portion 28*b*. The first groove portion 28*a* is closer to the first end 14 of the cavity than the second groove portion 28*b*. The first groove portion 28*a* has a greater radial depth than the second groove portion 28*b*.

As seen in FIG. 2A when the retaining element 20 is in a first position, the retaining element 20 is closest to the first end 14 of the cavity. In this position the consumable 2 can be introduced into the cavity 12 and is received by the retaining element 20. In this arrangement the consumable 2 is not securely held by the retaining element 20 and it can be easily removed from the mouthpiece portion 100.

When in this position, the protrusions 24 of the retaining element 20 are received in the corresponding first groove portions 28*a* in the internal side wall 18 of the retaining element 20. The depth of the first groove portions 28*a* ensures that the protrusions 24 can be comfortably accommodated within the first groove portions 28*a* without the retaining element 20 clamping the consumable 2 in the cavity 12.

FIG. 2B shows the mouthpiece portion 100 when the retaining element 20 is in the second position, being closer to the second end 16 of the cavity. This arrangement is achieved when the consumable 2 is inserted into the cavity 12, by moving the retaining element 20 from the first position to the second position. In this way, the protrusion 24 moves out of the first groove portions 28*a* in the side wall 18 and moves along groove 26 into the second groove portions 28*b* in the side wall 18.

As the second groove portions 28*b* are shallower than the first groove portions 28*a*, the side wall 18 imparts a force on the protrusion 24 causing the retaining element 20 to be compressed. This decreases the diameter of the cavity 12 causing a clamping effect to be imparted on the consumable 2 when in this second position. This is further aided by the slit 22 on the retaining element 20 allowing the retaining element 20 to be easily compressed.

The user can remove the consumable 2 from the mouthpiece portion 100 by pulling the consumable 2 in the opposite direction (out from the cavity 12) to that as described above, with the retaining element 20 moving from the second to the first position, such that the consumable 2 is no longer clamped by the retaining element 20 and can be readily removed from the device. The retaining portion 20 follows with the consumable 2 to transfer back to the first position. The friction between the retaining element 20 and the consumables 2 helps maintaining these parts together until the retaining element 20 is back in the first position wherein the consumable 2 can be released.

Although it has been shown that the retaining element in FIGS. 2A and 2B has two protrusions 24 on opposite sides of the retaining element 20, in other embodiments the retaining element may contain any number of protrusions 24. For instance, there may be a single protrusion, or alternatively there may be a plurality of protrusions greater than two. These protrusions may be located at different regions around the circumference of the retaining element 20. In addition, there may be a plurality of protrusions arranged in the axial direction.

Figure 3B:
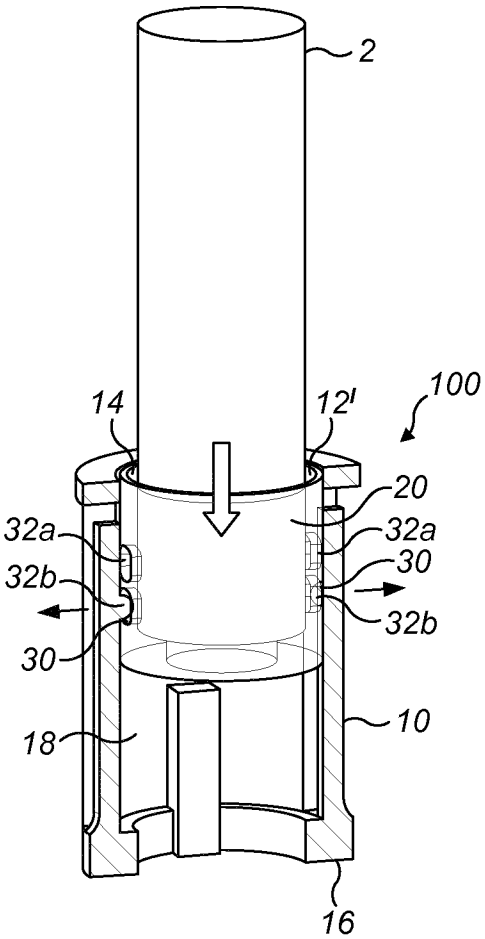
FIG. 3B is a side on cross-sectional view of a mouthpiece of an electronic cigarette and consumable in a first position, according to the second exemplary embodiment of the present invention.
Figure 3A:
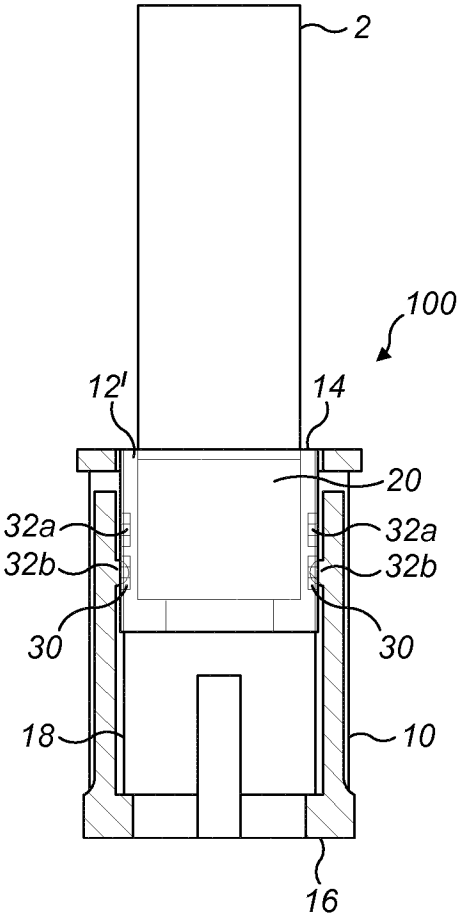
FIG. 3A is a side on cross-sectional view of a mouthpiece of an electronic cigarette and consumable in a first position, according to a second exemplary embodiment of the present invention.

FIGS. 3A and 3B are cross-sectional views of a mouthpiece 100 of an electronic cigarette 1 and consumable 2 according to a second exemplary embodiment of the present invention.

Similar to the embodiment shown in FIGS. 2A and 2B the mouthpiece portion 100 of FIGS. 3A and 3B has a housing sleeve 10, forming part of the mouthpiece portion 100. The housing sleeve 10 also comprises an opening at its first end 14, defining a cavity 12 having internal side wall 18. Within the cavity 12 of the housing sleeve 10 is located a retaining element 20. The retaining element 20 has a circular cross-sectional shaped having an inner region in which the consumable 2 is received. Although not shown, the retaining element 20 may comprise two slits on opposite sides of the retaining element 20, as in FIG. 2A.

In the embodiment shown in FIGS. 3A and 3B, a protrusion 30 is located on at least one side and preferably on each of the opposite sides of the sidewall of the cavity 12'. The retaining element 20 has at least one axial groove 32 comprising a first groove portion 32*a* and a second groove portion 32*b* located within said groove 32. The first groove portion 32*a* is closer to the first end 14 of the cavity than the second groove portion 32*b*. The second recess 32*b* is deeper than the first recess 32*a*.

FIG. 3A shows the mouthpiece portion 100 in a released position when the retaining element 20 is in a first position, which is closest to the first end 14 of the cavity. In this position the consumable 2 can be introduced into the cavity 12' and is received by the retaining element 20. In this arrangement the consumable 2 is not securely held by the retaining element 20 and it can be easily removed from the mouthpiece portion 100.

When in this position, the protrusion 30 on the sidewall 18 of the cavity 12 is received in the second groove portion 32*b* in the side wall 18 of the retaining element 20. The depth of the second groove portion 32*b* ensures that the protrusion 30 can be comfortably accommodated within the second recess 32*b* without the retaining element 20 clamping the consumable 2 in the cavity 12.

When the consumable 2 is further inserted into the mouthpiece portion 100, the retaining element 20 moves further into the cavity 12, as shown in FIG. 3B. The retaining element 20 moves further into the cavity 12 towards the second end 16 with the protrusion 30 moving from the second groove portion 32*b* along the groove to be accommodated in the first recess 32*a*. In doing so, as the first recess 32*a* is shallower than the second groove portion 32*b*, the protrusion 30 on the side wall imparts a force on the retaining element 20 causing the retaining element 20 to be compressed. This achieves a decrease in the diameter of the cavity 12, causing a clamping effect to be imparted on the consumable 2 when in this second position. Similar to the embodiment described in relation to FIGS. 2A and 2B, this can be further aided by having a slit 22 on the retaining element 20 allowing the retaining element 20 to be more easily compressed. The consumable 2 can then be removed as described in relation to the first embodiment.

In alternative embodiments the mouthpiece portion 100 may have a plurality of protrusions 30 located on each of the opposite sides of the side wall of the cavity 12, extending radially by different amounts, such that when in either the first or second position both protrusions 30 may be located in each of the recesses 32*a* 32*b* to provide an enhanced compression. In addition, there may be provided only a single protrusion on each side of the cavity and/or a single recess.

Figure 4A:
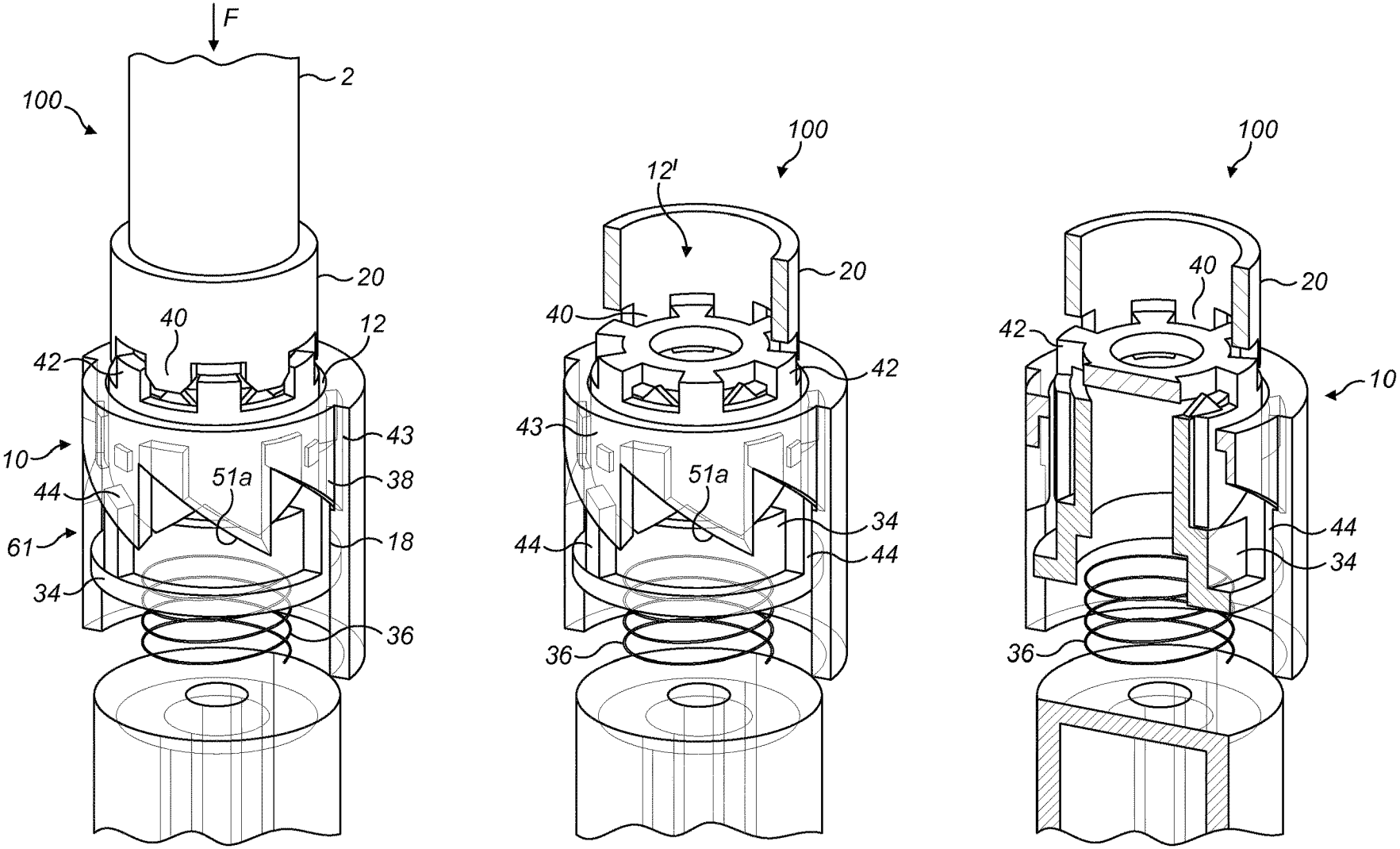
FIG. 4A is a side on cross-sectional views of a mouthpiece of an electronic cigarette and consumable, according to a third exemplary embodiment of the present invention.
Figure 4B:
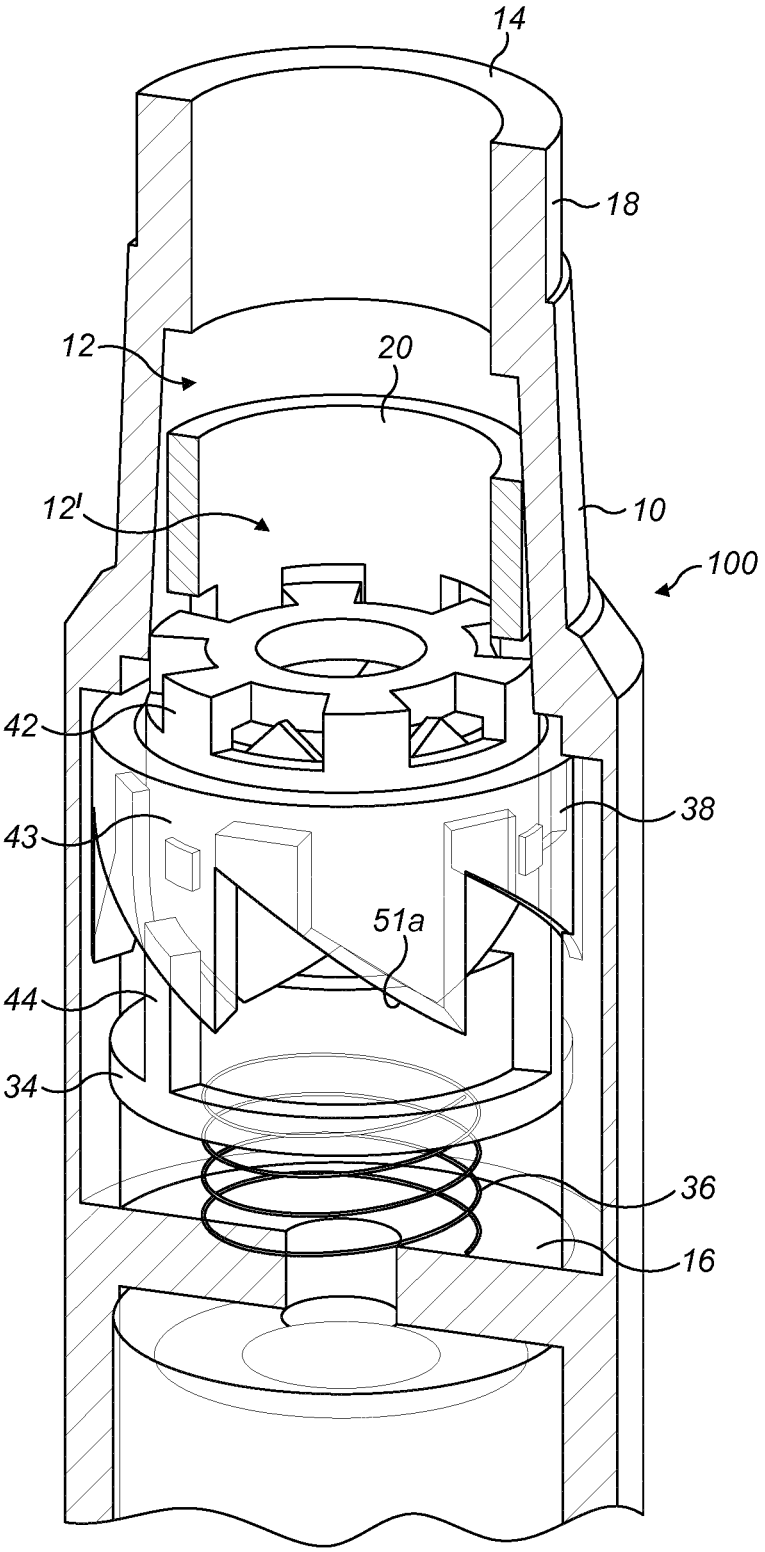
FIG. 4B is a further side on cross-sectional view of a mouthpiece of an electronic cigarette with no consumable, according to a third exemplary embodiment of the present invention.
Figure 4C:
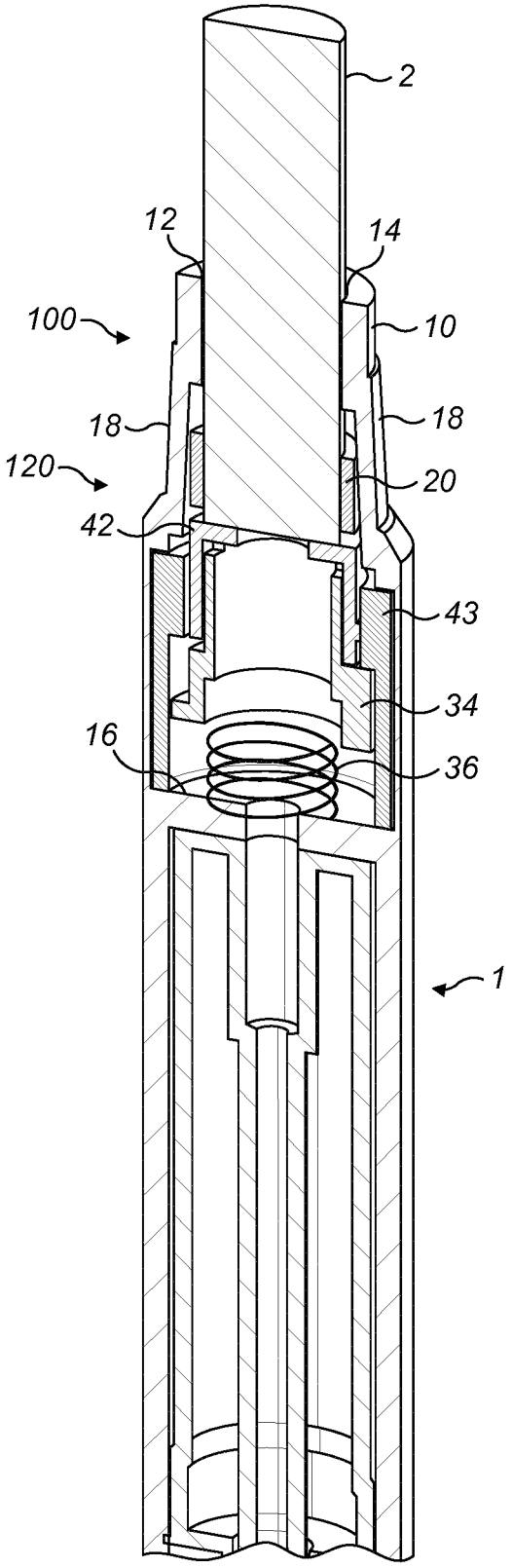
FIG. 4C is a perspective view of an electronic cigarette with a consumable, according to the third exemplary embodiment of the present invention where the consumable is in the locked position.

FIG. 4A-C show cross-sectional views of the mouthpiece portion 100 of an electronic cigarette 1 and consumable 2 according to a third exemplary embodiment of the present invention. FIG. 4A is showing three views of a section of the mouthpiece portion 100 each view successively cutaway to show the details of the arrangement.

Referring to FIG. 4A in particular, the mouthpiece portion 100 comprises a housing sleeve 10 having an opening 12 at its first end 14 and provided with an internal sidewall 18. A retaining element 20 is located within the housing sleeve 10 similar to in the previous embodiments. The retaining element 20 is cylindrically shaped having an inner region and defining the cavity 12' in which the consumable 2 is received. As mentioned in the previous embodiments the retaining element 20 may or may not have slits 22.

Figure 4D:
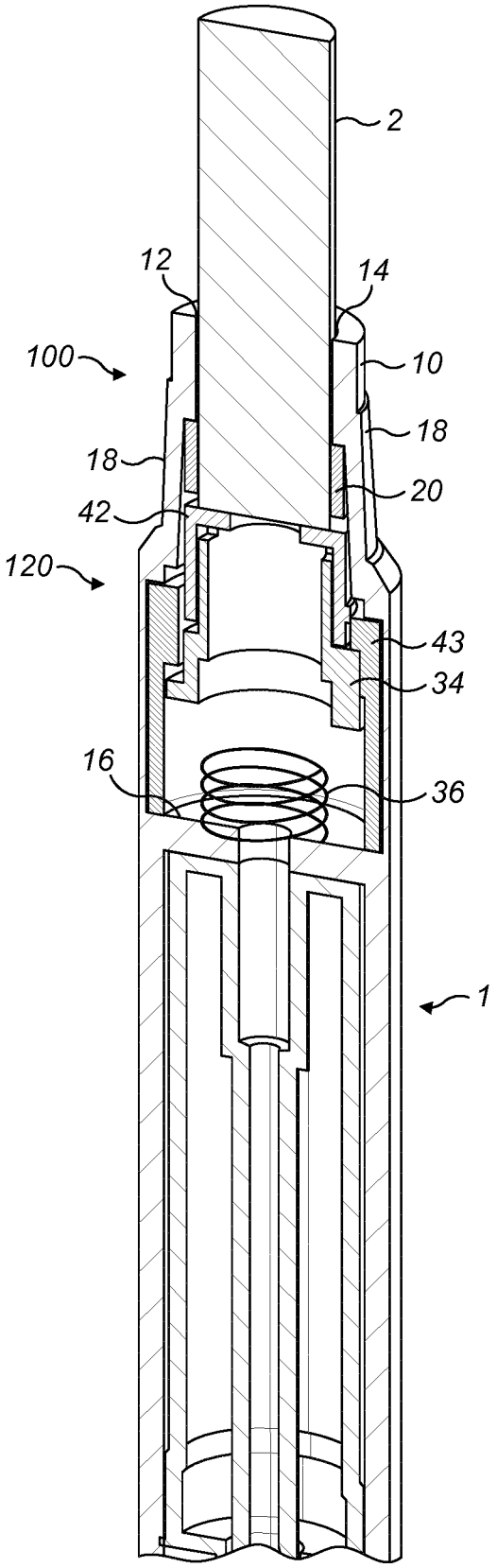
FIG. 4D is a further perspective view of an electronic cigarette with a consumable, according to the third exemplary embodiment of the present invention where the consumable is in the unlocked position.

As seen in FIGS. 4A to D and 5A and 5B, the electronic cigarette 1 further comprises an axial positioning arrangement 120 configured to move the consumable 2 between a released position as illustrated in FIG. 4C and a clamped position as illustrated in FIG. 4D. The axial positioning arrangement 120 shown in FIGS. 4A to 4D thus enables the locking of the consumable 2 in the device through a reciprocating mechanism.

The axial positioning arrangement 120 is connected to the retaining element 20 and comprises an axially movable base 42 to which the retaining element 20 is attached, a cam 34 configured to convert the axial movement of the base 42 to a rotational displacement, a biasing member (spring) 36 acting on the cam 34, and a guide 43 located on an internal surface of the housing sleeve 10. The guide 43 can be a separate part, stationary arranged in relation to the housing sleeve 10. Alternatively, the guide 43 is formed as a unitary part together with the housing sleeve 10.

The cam 34 is in engagement with the base 42 through a jagged connection 61 and the guide 43 is provided with a first guide surfaces 51*a* and second guide surface 51*b*. The guide surfaces 51*a*, 51*b* have a different length and a different geometry to each other. The first guide surface 51*a* additionally comprises a second resting surface 52*a*, which is also configured to hold and limit the axial movement of a sloping guide surface 44 of the cam 34.

The retaining element 20 is connected to the base 42 such that the cavity 12' is formed for receiving the consumable 2. The base 42 is axially movable between a position where the consumable 2 is clamped "a clamped position" and a position where the consumable 2 is released "a released position". The internal side wall 18 of the mouthpiece portion 10 is gradually tapered along its axis such that the diameter of the cavity 12 becomes smaller closer to the first end 14 than at the second end 16. This enables the retaining member 20 to press against the consumable 2.

The retaining mechanism thus moves the base 42 between the clamped and released positions in response to an axial force F applied onto the base 42. The axial force F can be applied to the base in an indirect manner by pressing onto the exposed extremity of the consumable 2.

Figure 5A:
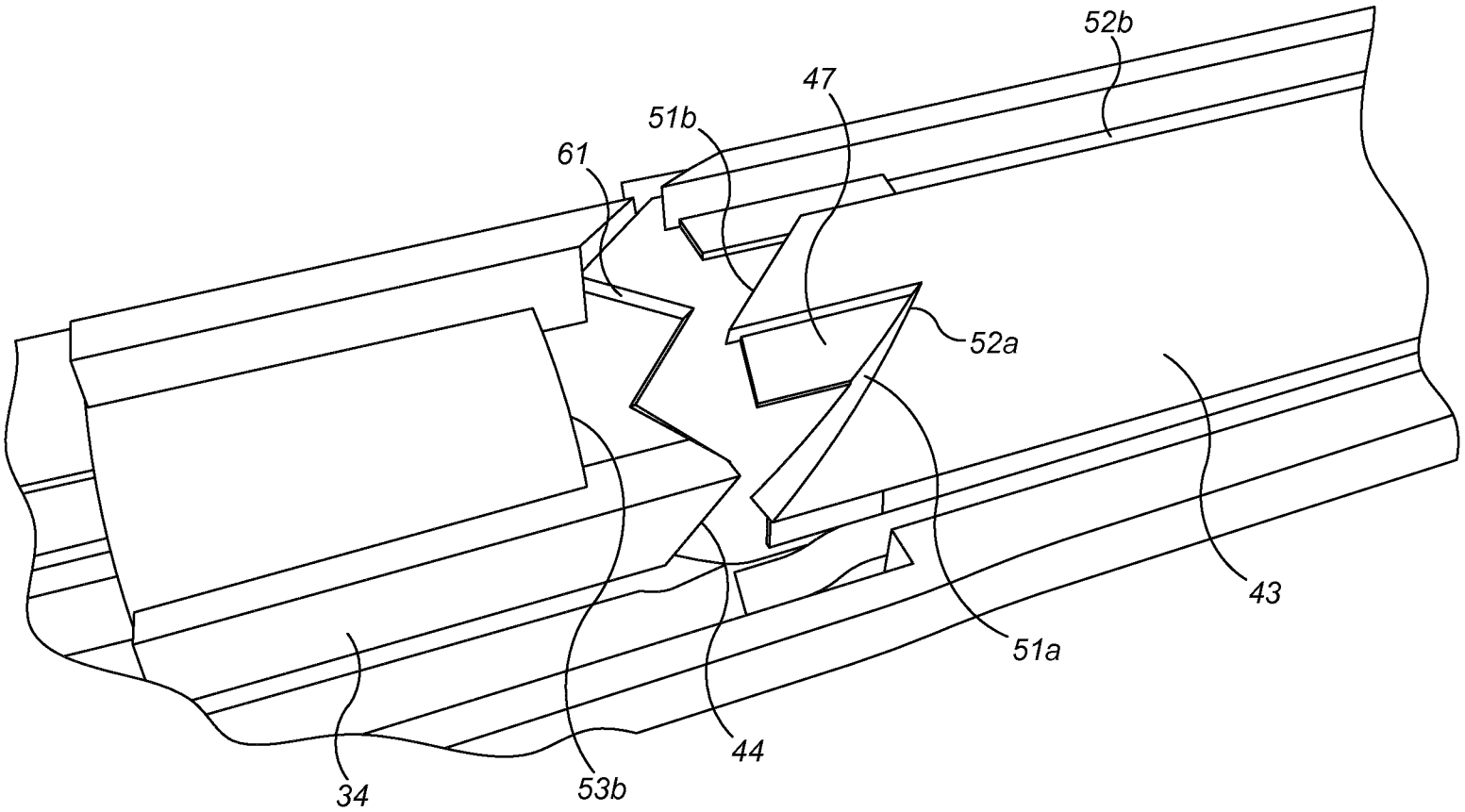
FIG. 5A is a further cross-sectional view of a mouthpiece of an electronic cigarette and consumable, according to a third exemplary embodiment of the present invention.
Figure 5B:
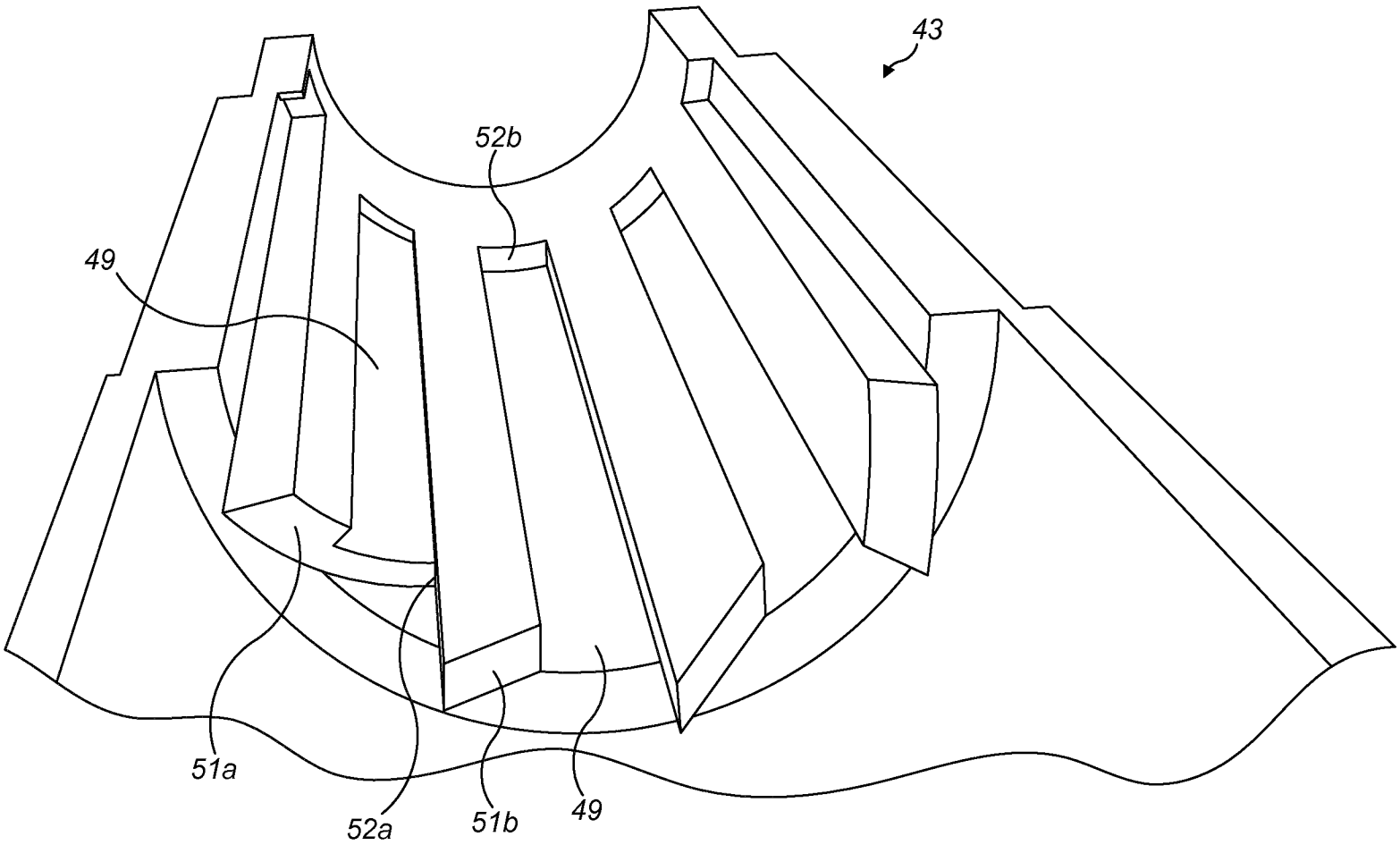
FIG. 5B. is a further cross-sectional views of the guide of the mouthpiece of an electronic cigarette and consumable, according to a third exemplary embodiment of the present invention.

As best seen in FIG. 5A, the base 42 is provided with a lower edge having a circular and jagged connection surface 61 operationally coupled to the corresponding sloping guide surfaces 44 of the cam 34. The sloping surfaces 44 of the cam 34 slide along the jagged connection surface 61 and cause a first rotation of the cam in relation to the base 42. The base 42 is axially movable but locked from rotational movement by the guide 43. To this effect, the base 42 may be provided with a longitudinal protruding guide rail 47 received within a corresponding slot 49 on the interior surface of the guide 43.

The angled guiding surfaces 51*a*, 51*b* of the guide 43 are configured to grasp the sloping guide surfaces 44 on the cam 34 and to cause an additional rotation. The guide 43 is stationary arranged in relation to the electronic cigarette (and does not move neither axially nor radially). As shown, the angled guiding surfaces 51*a*, 51*b* of the guide 43 in the present example represent a plurality of teeth. The number of teeth can be six, however more or fewer teeth may be provided as required. For instance, the guide 43 may have three, four, five, or more teeth.

The cam 34 is rotatable with respect to the movable base 42 and the retaining element 20. When the force Fis applied to the base 42, the cam 34 rotates whereby the cam surface 44 is brought into alternate contact with the first and second guide surfaces 51*a* and 51*b* depending on the angular position of the cam 34 in relation to the base 42. First and second resting surfaces 52*a*, 52*b* are positioned at different axial positions of the guide 43 such that the base 42 is also positioned in different axial positions.

The retaining element 20 may further be provided with tabs 40 received in corresponding recesses 41 in the base 42. This provides a resilient mating arrangement between the retaining element 20 and the base 42.

Depending on the angular position of the cam 34 in relation to the base 42, the spring 36 is compressed either to a short (first) length or not compressed when at a long (second) length. When the spring is compressed (i.e. has the shortest length), sloping guide surface 44 is abutting the first resting surface 52*a* and is locked in a first angular position. When the spring is not compressed (i.e. is at its longest length), the sloping guide surface 44 is abutting the second resting surface 52*b* and is locked in a second angular position.

When the consumable 2 is initially inserted into the cavity 12, the base 42 is in a first position. The first position is located deeper into the cavity 12 than the second position. Upon applying a force F to the consumable and inserting the consumable 2 into the cavity 12, the base 42 is pushed against the cam 34. The cam 34 arrangement is in turn pushed against the bias of the spring 36 further into the mouthpiece portion 100 towards the second end 16 of the cavity 12.

With this axial movement, the cam 34 also rotates, whilst the other elements do not rotate. This causes the angled surfaces 44 of the cam 34 to slide along the jagged surface of the base 42 while the guide surfaces 51*a* and 51*b* of the guide 43 provides an additional rotational movement. This causes the retaining element 20, and base 42 to move upwards towards the first end 14 of the cavity. Once the force pushing the consumable 2 into the device is removed, the retaining element 20, base 42, and cam are locked in this configuration. In this second position, the retaining portion 20 is now closer to the first end 14 of the cavity than when in the first configuration when the consumable was first pushed into the cavity.

When in the second configuration, where the retaining element 20 is closer to the first end of the cavity 14, due to the tapering of the internal side wall 18 towards the first end of the cavity 14 the side wall 18 impart a force on the retaining element 20 causing the retaining element 20 to be compressed. This results in a reduction in the diameter of the cavity 12, causing a clamping effect to be imparted on the consumable 2 when in this second configuration. This locks the consumable within the mouthpiece portion 100.

When the consumable 2 is to be removed from the device, a force F is applied downwards onto the consumable 2, causing the retaining member 20, barrel 42, and cam 34 to move downwards and the cam 34 to return to its initial configuration of having its angled surfaces 44 abutting against the second guide surface 51*b* through rotation of the cam, in the same way as was described above. This causes the retaining member 20 to move down, reducing the compression on the retaining element 20 holding the consumable 2, due to the larger diameter of the side wall reducing the force applied to the retaining element. This enables the consumable to be removed from the mouthpiece portion 100 as it is no longer locked.

The rotation of the cam 36 described above from the first configuration to the second configuration is 30°, i.e. between the configuration when the consumable is first inserted into the device and when it is clamped by the retaining element. This is a total of 60° rotation between the consumable 2 being inserted and the consumable 2 being released from the device when empty. However, rather than a 30° rotation of the cam between each position, this may vary in different embodiments. For instance, it may depend on the number of teeth 38 of the guide 43.

Although not shown in the device of FIG. 4, the electronic cigarette 1 of FIG. 4 may include a puff counting mechanism. The puff counting mechanism is responsible for counting the number of user's puffs of the electronic cigarette whilst the consumable 2 is inserted into the device.

When the consumable 20 is inserted in the cavity 12 and the consumable is in a clamped position as illustrated in FIG. 4D, the puff counting device may be initiated. The puff counting mechanism is then ready to detect each puff that the user takes to provide a visual display of the number of puffs taken. When the consumable 20 is then removed by moving to the released position as illustrated in FIG. 4C the puff counting mechanism is deactivated such that user's puffs are no longer detected when in the released position. In this way, the triggering of the puff mechanism when the device is clamped ensures that puffs are only counted when the consumable is correctly seated for use within the cavity.

Each time the consumable 2 is clamped in the device 1 the puff counting mechanism may be reset, such that it reads a value of zero. In this way the user may be aware of how many puffs have been taken for that particular consumable 20. In other arrangements, the puff counting mechanism may not reset to zero when the consumable 20 is released. This may be useful where the user wants to keep track of how much they have used the device over a longer period of time than when using a single consumable 20.

The puff counting mechanism may be a digital counter. Alternatively, it may be a mechanical counter. Each time the consumable 20 is inserted into the device 1 such that it is clamped in place the puff counting mechanism is activated such that it is ready to detect and count the number of times that the user inhales using the device.

Although above described above with respect to FIG. 4, it may be understood that the embodiments shown in FIGS. 1 to 3 may also include a puff counting mechanism.

Although it has been described in the embodiment shown in FIG. 4 that the internal side wall 18 is gradually tapered along their axis such that the diameter of the cavity 12 becomes smaller closer to the first end 14 than at the second end 16, in other embodiments the internal side wall may gradually taper so that the diameter of the cavity is smaller closer to the second end of the cavity than at the first end. In this case the consumable may be held by the retaining element as the retaining element 20 moves further into the cavity 12, as in the embodiments shown in FIG. 2 and FIG. 3.

Although the internal side wall 18 in the embodiments described above are described as being a singular side wall, it can be understood that this is because the housing sleeve has a cylindrical shape. In other embodiments, the housing sleeve may have other shapes, such as a cuboid shape, in this case the side wall may be considered as having a plurality of side walls.

In all of the embodiments described above the retaining element 20 and the housing sleeve 10 are made of a durable plastic that enables the compression of the retaining element 20. However, in other embodiments the retaining element 20 may be made of a flexible or rubber material with the toughened side walls of the housing sleeve imparting a force on the retaining element 20 in order to provide compression and hold the consumable 2.

In other embodiments rather than having slits 22 which extend a part the way down the retaining element 20, as can clearly be seen from FIG. 2A, the slits may extend the whole way down the retaining element 20 creating two separate sections of retaining elements 20 with a gap between them. The side wall 18 of the cavity imparts a force on each of the separate sections of the retaining elements 20 causing the clamping effect. Each of the separate sections of the retaining elements 20 are spaced apart enabling movement between the two sections of the retaining elements to impart the clamping. In other embodiments there may be any number of separate sections of the retaining elements separated by gaps as discussed above. For instance, the retaining element 20 may be separated into three, four, five, six or more separate sections 20.

In other embodiments, the compression provided from the side walls on the retaining element may be merely provided by having sidewalls that have a flared opening. In this situation the separation between opposing sides of the side wall may decrease towards the second end 16 of the cavity 12. This tapering of the side wall provides increased compression on the side wall as the retaining element 20 moves further into the cavity 12 when the consumable 2 is inserted into the retaining element 20, clamping the consumable 2 in the device. In other embodiments the flared opening may be in addition to the other means of compression as described in the other embodiments.

The consumable described herein can be a flavoured element. This may be a filter type element, similar to a conventional cigarette filter made from acetate. The filter may also comprise flavour or nicotine, and can be used by a liquid vaporiser as previously described.

The consumable may also be a tobacco rod configured for heating. The tobacco rod comprising a portion of tobacco material immersed with an aerosol forming substance such as propylene glycol or glycerine, which produces vapour, for use with heat not burn devices.

The invention claimed is:

1. A mouthpiece portion for an electronic cigarette, the mouthpiece portion comprising:

a housing sleeve comprising an opening and a cavity having an internal side wall, the housing sleeve being connectable to a main body of an electronic cigarette;

a retaining element located within said cavity, wherein the retaining element defines a receiving space for receiving a portion of a consumable and is configured to move within the housing sleeve in an axial direction of the mouthpiece portion between a first position and a second position;

wherein the retaining element is compressed in a radial direction against the consumable when the retaining element is in the second position; and wherein the cavity is provided with a first portion having a first diameter and a second portion having a second diameter, wherein the second diameter is smaller than the first diameter, wherein the retaining element comprises a protrusion, and the side wall of the cavity comprises at least one axial groove configured to receive the protrusion and guide the protrusion so that the retaining element can move between the first and second positions, and wherein the at least one axial groove comprises at least a first recess and a second recess, the first recess configured to engage with the protrusion when the retaining element is in the first position and the second recess configured to engage with the protrusion when the retaining element is in the second position, wherein the first recess has a greater radial depth than the second recess.

2. The mouthpiece portion according to claim 1, wherein the consumable is released or partially released from the retaining element when the retaining element is in the first position.

3. The mouthpiece portion according to claim 2, wherein the first portion and the second portion are located at different longitudinal positions in an axial direction of the cavity.

4. The mouthpiece portion of claim 1, wherein the side wall is flared.

5. The mouthpiece portion according to claim 4, wherein the flared side wall defines a tapered angle which is inwardly tapered in a direction towards a vapour outlet in the mouthpiece portion.

6. The mouthpiece portion according to claim 1, wherein the retaining element is a flexible sleeve.

7. The mouthpiece portion of claim 1, wherein the side wall of the cavity has a tapered profile along the axial direction.

8. The mouthpiece portion of claim 1, wherein the retaining element comprises one or more slits extending along at least a portion of the retaining element in the axial direction, which allows compression or expansion of the retaining element.

9. The mouthpiece portion of claim 8, wherein the one or more slits separate the retaining element into separate sections.

10. An electronic cigarette comprising the mouthpiece portion of claim 1.

11. A mouthpiece portion for an electronic cigarette, the mouthpiece portion comprising:

a housing sleeve comprising an opening and a cavity having an internal side wall, the housing sleeve being connectable to a main body of an electronic cigarette;

a retaining element located within said cavity, wherein the retaining element defines a receiving space for receiving a portion of a consumable and is configured to move within the housing sleeve in an axial direction of the mouthpiece portion between a first position and a second position, wherein the retaining element is compressed in a radial direction against the consumable when the retaining element is in the second position; and wherein the cavity is provided with a first portion having a first diameter and a second portion having a second diameter, wherein the second diameter is smaller than the first diameter, wherein the retaining element engages the second portion when in the second position, and wherein the side wall of the cavity comprises a protrusion, and wherein the retaining element comprises an axial groove having a variable radial depth such that the retaining element can move between the first and second positions, and wherein the retaining element comprises at least one recess having a first portion and a second portion, wherein the first portion and the second portion have different radial depths, whereby the second portion is configured to engage with the protrusion when the retaining element is in the first position and the first portion is configured to engage with the protrusion when the retaining element is in the second position.

12. A mouthpiece portion for an electronic cigarette, the mouthpiece portion comprising:

a housing sleeve comprising an opening and a cavity having an internal side wall, the housing sleeve being connectable to a main body of an electronic cigarette;

a retaining element located within said cavity, wherein the retaining element defines a receiving space for receiving a portion of a consumable and is configured to move within the housing sleeve in an axial direction of the mouthpiece portion between a first position and a second position;

wherein the retaining element is compressed in a radial direction against the consumable when the retaining element is in the second position;

wherein the cavity is provided with a first portion having a first diameter and a second portion having a second diameter, wherein the second diameter is smaller than the first diameter, and wherein the retaining element is further connected to an axial positioning arrangement configured to reciprocately move and retain the retaining element in a released position and a clamped position when a force is applied to the consumable.

13. The mouthpiece portion of claim 12, wherein the retaining mechanism is biased into the clamped position.

14. The mouthpiece portion of claim 12, wherein the axial positioning arrangement comprises:

an axially movable base to which the retaining element is attached;

a cam configured to convert axial movement of the base to a rotational displacement;

a biasing member acting on the cam in order to bias the cam in the axial direction against the base; and a guide located on an internal surface of the housing sleeve.

15. The mouthpiece portion according to claim 12, wherein the consumable is released or partially released from the retaining element when the retaining element is in the first position.

16. The mouthpiece portion according to claim 15, wherein the first portion and the second portion are located at different longitudinal positions in an axial direction of the cavity.

17. The mouthpiece portion of claim 12, wherein the side wall is flared.

18. The mouthpiece portion according to claim 17, wherein the flared side wall defines a tapered angle which is inwardly tapered in a direction towards a vapour outlet in the mouthpiece portion.

19. The mouthpiece portion according to claim 12, wherein the retaining element is a flexible sleeve.

* * * * *